US010786893B2

(12) United States Patent
Nitsch et al.

(10) Patent No.: US 10,786,893 B2
(45) Date of Patent: Sep. 29, 2020

(54) SWITCHING DEVICE FOR A PORTABLE POWER TOOL, IN PARTICULAR A HAMMER DRILL AND/OR CHISEL HAMMER

(71) Applicant: Robert Bosch GmbH, Stuttgart (DE)

(72) Inventors: Daniel Nitsch, Weinstadt (DE); Jan-Simon Blind, Steinenbronn (DE); Charlotte Meiser, Kernen Im Remstal (DE); Hardy Schmid, Stuttgart (DE); Rudi Habermann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 218 days.

(21) Appl. No.: 15/713,381

(22) Filed: Sep. 22, 2017

(65) Prior Publication Data

US 2018/0085906 A1 Mar. 29, 2018

(30) Foreign Application Priority Data

Sep. 27, 2016 (DE) ..... 10 2016 218 535

(51) Int. Cl.
*B25D 17/04* (2006.01)
*B25D 16/00* (2006.01)

(52) U.S. Cl.
CPC ..... *B25D 16/006* (2013.01); *B25D 17/043* (2013.01); *B25D 2216/0023* (2013.01); *B25D 2216/0084* (2013.01); *B25D 2250/121* (2013.01); *B25D 2250/221* (2013.01); *B25D 2250/255* (2013.01); *B25D 2250/261* (2013.01)

(58) Field of Classification Search
CPC ..... B25D 16/006; B25D 17/043; B25D 2250/261; B25D 2250/255; B25D 2250/221; B25D 2216/0084; B25D 2216/0023; B25D 2250/121
See application file for complete search history.

(56) References Cited

U.S. PATENT DOCUMENTS 4,204,580 A * 5/1980 Nalley ..... B25D 16/00 173/170
6,550,545 B1 * 4/2003 Manschitz ..... B25D 16/006 173/170
6,868,919 B1 * 3/2005 Manschitz ..... B25D 16/006 173/47

(Continued)

FOREIGN PATENT DOCUMENTS

DE 43 44 817 C2 6/1995
DE 196 41 618 A1 4/1998

(Continued)

*Primary Examiner* — Hemant Desai
*Assistant Examiner* — Christopher Robin Kim
(74) *Attorney, Agent, or Firm* — Maginot, Moore & Beck LLP

(57) ABSTRACT

A switching device for a portable power tool includes at least one operating mode selection unit, which has at least one movably mounted operating element for selecting an operating mode of the portable power tool. The switching device also has at least one locking unit for locking the operating element in at least one movement position of the operating element. The locking unit has at least one movably mounted locking element which, depending on a locking position of the locking element, triggers an electric and/or electronic signal for switching an operating mode of the portable power tool.

11 Claims, 4 Drawing Sheets

(56) References Cited

U.S. PATENT DOCUMENTS

2004/0231866 A1* 11/2004 Droste ..... B25D 16/006 173/48
2006/0011361 A1* 1/2006 Shimma ..... B25D 16/006 173/48
2006/0113097 A1* 6/2006 Simm ..... B25D 16/006 173/48
2008/0017396 A1* 1/2008 Kristen ..... B25D 17/043 173/162.2
2008/0210448 A1* 9/2008 Ullrich ..... B25D 16/006 173/104
2009/0008111 A1* 1/2009 Liebert ..... B25D 17/043 173/18
2009/0056965 A1* 3/2009 Moessnang ..... B25D 16/006 173/18
2009/0145617 A1* 6/2009 Duesselberg ..... B25F 5/001 173/48
2010/0084151 A1* 4/2010 Kuhnle ..... G05G 1/12 173/47
2012/0205131 A1* 8/2012 Furusawa ..... B25F 5/02 173/2
2016/0023344 A1* 1/2016 Bernhart ..... G05G 1/10 173/48
2016/0195185 A1* 7/2016 Rompel ..... F16H 57/08 475/331
2018/0043521 A1* 2/2018 Moessnang ..... B25F 5/00
2018/0085906 A1* 3/2018 Nitsch ..... B25D 16/006
2018/0250802 A1* 9/2018 Iida ..... B25D 16/006
2018/0361553 A1* 12/2018 Brinkmann ..... B25D 16/006
2019/0084109 A1* 3/2019 Nemetz ..... B25D 16/00

FOREIGN PATENT DOCUMENTS

DE 10 2005 059 182 A1 6/2007
DE 20 2013 001 457 U1 4/2013
EP 0 612 588 A1 8/1994
EP 0 666 148 A1 8/1995
EP 1 080 849 A2 3/2001
EP 2 062 670 A2 5/2009
EP 2 481 526 A1 8/2012
GB 2 285 764 A 7/1995
GB 2 314 288 A 12/1997
WO 88/06508 A2 9/1988

* cited by examiner

SWITCHING DEVICE FOR A PORTABLE POWER TOOL, IN PARTICULAR A HAMMER DRILL AND/OR CHISEL HAMMER

This application claims priority under 35 U.S.C. § 119 to patent application number DE 10 2016 218 535.7, filed on Sep. 27, 2016 in Germany, the disclosure of which is incorporated herein by reference in its entirety.

BACKGROUND

Switching devices for portable power tools, in particular for hammer drills and/or chisel hammers, are already known, wherein the known switching devices comprise at least one operating mode selection unit which has at least one movably, in particular rotatably, mounted operating element for selecting an operating mode of the portable power tools, and which switching devices comprise at least one locking unit for locking the operating element in at least one movement position of the operating element, in particular in at least one rotational position of the operating element.

SUMMARY

The disclosure is based on a switching device for a portable power tool, in particular for a hammer drill and/or chisel hammer, comprising at least one operating mode selection unit which has at least one movably, in particular rotatably, mounted operating element for selecting an operating mode of the portable power tool, and comprising at least one locking unit for locking the operating element in at least one movement position of the operating element, in particular in at least one rotational position of the operating element, which rotational position is assigned in particular to an operating mode.

It is proposed that the locking unit has at least one movably mounted locking element which, depending on a locking position of the locking element, triggers an electric and/or electronic signal for switching an operating mode of the portable power tool. A "locking unit" is intended to be understood as meaning in particular a unit which has at least two interacting elements, in particular locking elements, which are provided to interact with each other for locking purposes, in particular to be brought into contact such that a locking force can be transmitted via the two elements in order to secure/hold a further element in at least one movement position of the further element, in particular in order to avoid an unintentional movement of the further element. "Provided" is intended to be understood as meaning in particular specially designed and/or specially equipped. The fact that an object is provided for a certain function is intended to be understood as meaning in particular that the object carries out and/or implements said certain function in at least one use state and/or operating state.

The operating element is preferably mounted rotatably about a movement axis of the operating element. The movement axis of the operating element preferably runs transversely, in particular at least substantially perpendicularly, to a main axis of extent of the portable power tool and/or to a percussion axis of a percussion unit of the portable power tool. The expression "substantially perpendicularly" is intended here to define in particular an orientation of a direction relative to a reference direction, wherein the direction and the reference direction, in particular as viewed in a plane, enclose an angle of 90°, and the angle has a maximum deviation of in particular less than 8°, advantageously less than 5° and particularly advantageously less than 2°. The locking unit is preferably provided to lock the operating element in a movement position of the operating element, in particular in at least one rotational position of the operating element, said rotational position being assigned in particular to an operating mode. The locking unit is preferably designed as a latching unit. The locking unit advantageously comprises the locking element which is designed as a latching element. In particular, the locking element is provided to interact with a latching recess of a latching contour of the locking unit in order to lock the operating element in a movement position of the operating element, in particular in at least one rotational position of the operating element, said rotational position being assigned in particular to an operating mode. The locking element is preferably mounted movably on the operating element, in particular in a translationally movable manner. A movement axis of the locking element preferably runs transversely, in particular at least substantially perpendicularly, to the movement axis of the operating element. The locking unit preferably comprises a spring element which acts upon the locking element with a spring force in the direction of a locking position, in particular in a direction directed away from the operating element.

The locking element is preferably provided to interact with a switching element of the switching device in order to trigger an electric and/or electronic signal for switching an operating mode of the portable power tool, in particular in a locking position of the locking element assigned to a chisel mode of the portable power tool. A "locking position of the locking element" is intended to be understood as meaning in particular a position of the locking element, in which the locking element locks the operating element in a movement position of the operating element and in particular engages in the latching contour of the locking unit, in particular engages in the latching recess of the latching contour. In the locking position of the locking element, the locking element can interact directly with the switching element, or can interact with the switching element with the interconnection of a further element, in particular an intermediate element, of the switching device.

In a preferred configuration of the portable power tool as a hammer drill and/or chisel hammer, the operating mode selection unit is provided in particular at least for selecting an operating mode of the portable power tool, said operating mode being designed as a drilling mode, as a hammer drill mode and/or as a chisel mode. In a drilling mode, an insertable tool is preferably rotationally drivable in a manner already known to a person skilled in the art. In a hammer drill mode, an insertable tool is preferably rotationally and percussively drivable in a manner already known to a person skilled in the art. In a chisel mode, an insertable tool is preferably drivable percussively in a manner already known to a person skilled in the art. A hammer drill and/or chisel hammer are/is included in particular in a device class having a high driving power. In order in particular in a drilling mode or in a hammer drill mode, to prevent what are referred to as rotation accidents due to blocking of the insertable tool by a reaction torque acting on the portable power tool, the portable power tool preferably has a unit, which is already known to a person skilled in the art, for determining a relative angle of rotation of a housing of the portable power tool. Examples of units for determining a relative angle of rotation are described, for example, in the documents WO 88 06 508 A3, DE 43 44 817 C2 or EP 0 666 148 A2 and DE 196 41 618 A1. In a chisel mode, for example, a risk of inadvertently occurring rotation accidents, in particular rotation accidents as already mentioned above, is low since the insertable tool is drivable only percussively. In the chisel mode, individual electric system functions of the portable power tool can preferably be set differently than in the drilling mode and/or hammer drill mode. In particular, an inadvertent switching off or a reduction in a driving power of the portable power tool in a chisel mode as a consequence of a limit value of an angle of rotation being exceeded is undesirable since a working process can be slowed down as a result. This applies in particular to applications and working processes in the chisel mode, in which an abrupt rotary movement of the portable power tool is unavoidable, for example in the event of what is referred to as "scabbling" on borders and edges of a concrete structure, when cutting wall openings by means of chisels and the like. In an advantageous manner, when the chisel mode is selected, at least the unit for determining a relative angle of rotation of a housing of the portable power tool should be deactivated, and/or individual operating parameters of the portable power tool should be changed. Reliable identification of an operating mode is therefore advantageous in order to permit reliable deactivation and/or changing of operating parameters. By means of the configuration according to the disclosure, a certain and reliable allocation of a movement position of the operating element to an operating mode of the portable power tool can advantageously be made possible in order preferably to realize reliable switching of an operating mode. Reliable triggering of an electric and/or electronic signal for switching an operating mode of the portable power tool can advantageously be realized.

Furthermore, it is proposed that the operating mode selection unit has at least one, in particular translationally and movably mounted intermediate element which, for triggering an electric and/or electronic signal for switching an operating mode of the portable power tool, is movable by the locking element depending on a movement of the locking element into at least one locking position of the locking element. For triggering an electric and/or electronic signal for switching an operating mode of the portable power tool, the intermediate element is preferably movable by the locking element depending on a movement of the locking element into at least one locking position of the locking element, said locking position being assigned to a chisel mode of the portable power tool. In particular, the intermediate element is provided to interact directly with the switching element of the switching device, in particular with an end of the intermediate element that faces away from the locking element. The switching element is preferably designed as a Hall sensor. A magnet element, in particular a permanent magnet, is preferably arranged on the intermediate element, and is provided for interacting with the Hall sensor in a manner already known to a person skilled in the art in order to trigger an electric and/or electronic signal. Alternatively, it is conceivable for the switching element to be designed as an electric switch, in particular as a microswitch, as an inductive proximity sensor, as a light barrier or as another switching element appearing expedient to a person skilled in the art. By means of the configuration according to the disclosure, bridging of a distance between the locking element and the switching element can be made possible in a structurally simple manner. An arrangement of the switching element at a distance from the locking element can advantageously be made possible, in particular for permitting a compact arrangement of electric and/or electronic components in an assembly which is arranged at a distance from the locking element in a housing of the portable power tool. A safety distance, such as, for example, an air gap distance, a creep distance or the like, can advantageously be observed in a structurally simple manner. Certain and reliable allocation of a movement position of the operating element to an operating mode of the portable power tool can advantageously be made possible in order preferably to realize reliable switching of an operating mode. Reliable triggering of an electric and/or electronic signal for switching an operating mode of the portable power tool can advantageously be realized.

Furthermore, it is proposed that the locking unit has at least one latching contour which, for locking the operating element in at least one movement position, in particular in at least one movement position which is assigned to an operating mode, of the operating element, interacts with the locking element, wherein at least the intermediate element at least partially engages in the latching contour in at least one state. The intermediate element preferably at least partially engages in a latching recess of the latching contour, said latching recess being assigned to a chisel mode. In a movement position of the operating element assigned to the chisel mode and in the locking position of the locking element assigned to the chisel mode, the locking element preferably at least partially engages in the latching recess of the latching contour, in particular in order to lock the operating element in a movement position of the operating element assigned to a chisel mode. During a movement into the locking position of the locking element, said locking position being assigned to a chisel mode, the locking element preferably at least partially moves the intermediate element out of the latching recess assigned to a chisel mode. The latching contour is preferably formed integrally with a housing, in particular with a gear housing, of the portable power tool. In particular, the latching contour is arranged under the operating element, as viewed along the movement axis of the operating element. In a state of the operating element in which the latter is arranged on the housing, in particular on the gear housing, of the portable power tool, the operating element preferably overlaps the latching contour, in particular as viewed along a direction running at least substantially parallel to the movement axis of the operating element. "Substantially parallel" is intended to be understood here as meaning in particular an orientation of a direction relative to a reference direction, in particular in a plane, wherein the direction is a deviation of in particular less than 8°, advantageously less than 5° and particularly advantageously less than 2°, in relation to the reference direction. By means of the configuration according to the disclosure, reliable actuation and/or movement of the intermediate element by means of the locking element can advantageously be made possible, in particular when the locking element moves into a locking position of the locking element, which locking position is assigned to a chisel mode of the portable power tool. Certain and reliable allocation of a movement position of the operating element to an operating mode of the portable power tool can advantageously be made possible in order preferably to realize reliable switching of an operating mode. Reliable triggering of an electric and/or electronic signal for switching an operating mode of the portable power tool can advantageously be realized.

In addition, it is proposed that the operating mode selection unit has at least one spring element which acts upon the intermediate element with a spring force in the direction of the locking element. A "spring element" is intended to be understood as meaning in particular a microscopic element which has at least one extent which, in a normal operating state, is elastically changeable by at least 10%, in particular by at least 20%, preferably by at least 30% and particularly advantageously by at least 50%, and which in particular generates a counter force which is dependent on a change in the extent and is preferably proportional to the change and opposes the change. An "extent" of an element is intended to be understood as meaning in particular a maximum distance of two points of a perpendicular projection of the element onto a plane. A "macroscopic element" is intended to be understood as meaning in particular an element with an extent of at least 1 mm, in particular of at least 5 mm and preferably of at least 10 mm. The spring element is preferably designed as a compression spring, in particular as a helical compression spring. However, it is also conceivable for the spring element to have a different configuration appearing expedient to a person skilled in the art, for example a configuration as a tension spring, as a torsion spring, as a volute spring, as a leaf spring, as a leg spring or the like. Automatic resetting of the intermediate element can advantageously be made possible by means of the configuration according to the disclosure. Certain and reliable allocation of a movement position of the operating element to an operating mode of the portable power tool can advantageously be made possible in order preferably to realize reliable switching of an operating mode. Reliable triggering of an electric and/or electronic signal for switching an operating mode of the portable power tool can advantageously be realized.

Furthermore, it is proposed that the intermediate element has at least one contact surface which, for the movement of the intermediate element, interacts with a corresponding contact surface of the locking element depending on a movement of the locking element into at least one locking position of the locking element. The contact surface of the locking element preferably runs transversely, in particular at least substantially perpendicularly, with respect to latching surfaces of the locking element. The latching surfaces of the locking element are preferably provided to interact with borders of the latching contour that bound latching recesses of the latching contour, in order to lock the operating element in at least one movement position. Reliable movement of the intermediate element by means of the locking element can advantageously be achieved by means of the configuration according to the disclosure. Certain and reliable assignment of a movement position of the operating element to an operating mode of the portable power tool can advantageously be made possible in order preferably to realize reliable switching of an operating mode. Reliable triggering of an electric and/or electronic signal for switching an operating mode of the portable power tool can advantageously be realized.

Furthermore, it is proposed that the contact surface of the intermediate element encloses an angle differing from 90° with a movement axis of the intermediate element. The contact surface of the intermediate element preferably encloses an angle from an angular range of in particular 0° to 90°, of preferably 10° to 70° and of particularly preferably 20° to 50°, with a movement axis of the intermediate element. The movement axis of the intermediate element preferably runs transversely, in particular at least substantially perpendicularly, with respect to the movement axis of the operating element. The movement axis of the intermediate element preferably runs at least substantially parallel to the main axis of extent of the portable power tool and/or to the percussion axis of the percussion unit of the portable power tool. Reliable movement of the intermediate element by means of the locking element can advantageously be made possible by means of the configuration according to the disclosure. Reliable switching of an operating mode can advantageously be realized. Reliable triggering of an electric and/or electronic signal for switching an operating mode of the portable power tool can advantageously be realized.

In addition it is proposed that the intermediate element is designed as a push rod. The intermediate element is preferably mounted translationally movably translationally in the housing, in particular in the transmission housing, of the portable power tool. Reliable movement of the intermediate element by means of the locking element can be made possible in a structurally simple manner by means of the configuration according to the disclosure. Reliable switching of an operating mode can advantageously be realized. Reliable triggering of an electric and/or electronic signal for switching an operating mode of the portable power tool can advantageously be realized.

Furthermore, it is proposed that the intermediate element has at least three limbs which are angled relative to one another, wherein at least two of the three limbs run at least substantially parallel to one another. The at least two of the three limbs, the limbs running at least substantially parallel to one another, preferably run at least substantially parallel to the main axis of extent of the portable power tool and/or to the percussion axis of the percussion unit of the portable power tool. One of the three limbs of the intermediate element preferably runs transversely, in particular at least substantially perpendicularly, with respect to the main axis of extent of the portable power tool and/or with respect to the percussion axis of the percussion unit of the portable power tool. However, it is also conceivable for the intermediate element to have a number of limbs differing from three, in particular limbs which are angled relative to one another.52 An arrangement of the switching element at a distance from the locking element can advantageously be made possible by means of the configuration according to the disclosure, in particular for permitting a compact arrangement of electric and/or electronic components in an assembly which is arranged at a distance from the locking element in a housing of the portable power tool. Reliable switching of an operating mode can advantageously be realized. Reliable triggering of an electric and/or electronic signal for switching an operating mode of the portable power tool can advantageously be realized.

Furthermore, it is proposed that the locking element has at least one actuating surface for a dynamic effect of an operator force, and at least one locking surface which is arranged offset along a movement axis of the locking element relative to the actuating surface. The locking surface of the locking element is preferably arranged in a latching recess of the latching contour in a locking position of the locking element. In particular, the locking surface of the locking element forms the contact surface of the locking element, said contact surface being provided to interact with the contact surface of the intermediate element for movement of the intermediate element. The actuating surface of the locking element is preferably arranged offset relative to the locking surface of the locking element along a direction running at least substantially parallel to the movement axis of the locking element. A compact configuration of the locking unit can advantageously be realized. Reliable switching of an operating mode can advantageously be realized. Reliable triggering of an electric and/or electronic signal for switching an operating mode of the portable power tool can advantageously be realized.

In addition, a portable power tool, in particular a hammer drill and/or chisel hammer, with at least one switching device according to the disclosure is proposed. A "portable power tool" is intended to be understood here as meaning in particular a power tool for machining work pieces, which power tool can be transported by an operator without a transport machine. The portable power tool in particular has a mass which is smaller than 40 kg, is preferably smaller than 10 kg and is particularly preferably smaller than 5 kg. The portable power tool is preferably designed as a hammer drill and/or chisel hammer. However, it is also conceivable for the portable power tool to have a different configuration appearing expedient to a person skilled in the art, such as, for example, a configuration as a compass saw, as a multi-function grinding machine or the like. The portable power tool preferably comprises at least one percussion unit. The term "percussion unit" is intended here in particular to define a unit which has at least one component, in particular the percussion element, which is provided for generating and/or transmitting a pulse, in particular an axial percussion pulse, to an insertable tool. Such a component for generating and/or transmitting a pulse can be formed in particular by the percussion element which is designed, for example, as a percussion pin, as a beater, as a piston, in particular as a piston tube, and/or as another component appearing expedient to a person skilled in the art. The percussion element of the percussion unit is preferably designed as a percussion pin or snap head die which advantageously forms a percussion element separate from a beater of the percussion unit and comes directly into contact with the insertable tool for transmission of a pulse, in particular during operation of the hammer drill and/or chisel hammer. The percussion unit preferably has at least one further percussion element which is designed as a beater which, for transmitting a percussion pulse to the percussion element designed as a percussion pin, is moved within the guide element, in particular within the guide element designed as a hammer tube and/or as a piston tube. In order to generate a percussion pulse, the beater is preferably moved within the guide element by means of a pressure, in particular by means of an air pressure generated by a piston guided in the guide element, which is designed as a hammer tube. Certain and reliable assignment of a movement position to an operating mode can advantageously be made possible by means of the configuration according to the disclosure in order preferably to realize reliable switching of an operating mode. Reliable triggering of an electric and/or electronic signal for switching an operating mode of the portable power tool can advantageously be realized. Safe and reliable operation of the portable power tool can advantageously be made possible.

The switching device according to the disclosure and/or the portable power tool according to the disclosure are/is not intended to be limited here to the above-described use and embodiment. In particular, in order to realize a manner of operation described herein, the switching device according to the disclosure and/or the portable power tool according to the disclosure may have a number of individual elements, components and units, and also method steps differing from a number stated herein. In addition, in the case of the value ranges indicated in this disclosure, values lying within the limits mentioned are also intended to be considered to be disclosed and usable as desired.

BRIEF DESCRIPTION OF THE DRAWINGS

Further advantages will emerge from the description below of the drawing. The drawing illustrates an exemplary embodiment of the disclosure. The drawing and the description contain numerous features in combination. A person skilled in the art will expediently also consider the features individually and combine them to form meaningful further combinations.

In the drawing.

DETAILED DESCRIPTION

Figure 1:
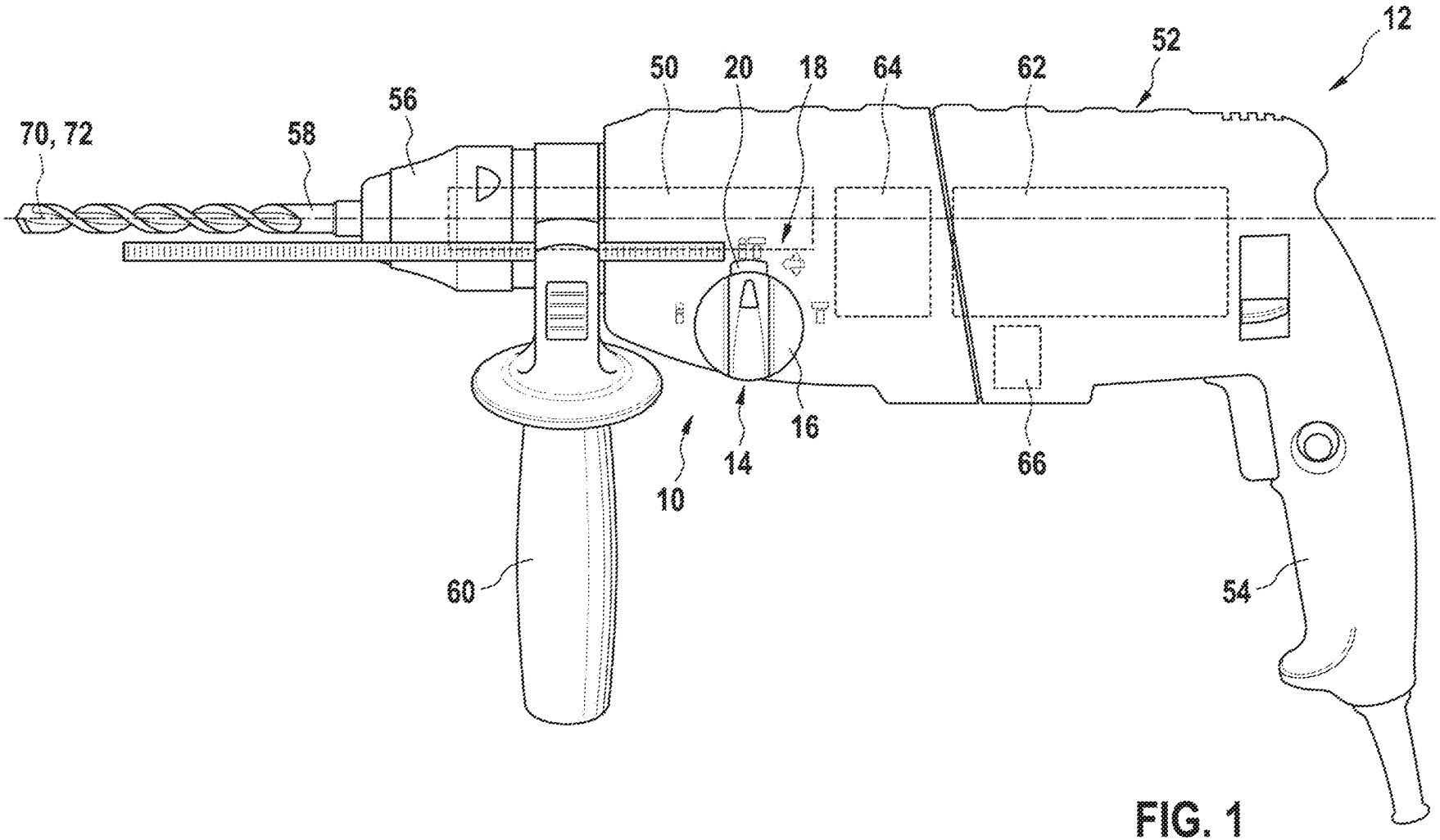
FIG. 1 shows a schematic illustration of a portable power tool according to the disclosure.

FIG. 1 shows a portable power tool 12 which is designed as a hammer drill and/or chisel hammer. However, it is also conceivable for the portable power tool 12 to have a different configuration appearing expedient to a person skilled in the art, such as, for example, as a drilling machine, as a planing machine, as a garden machine or the like. The portable power tool 12 comprises at least one percussion unit 50, in particular in the preferred configuration as a hammer drill and/or chisel hammer. Furthermore, the portable power tool 12 comprises a housing 52. The housing 52 preferably comprises at least one transmission housing and at least one motor housing. The housing 52, in particular the transmission housing, has in particular a cup-shaped configuration. However, it is also conceivable for the housing 52, in particular the transmission housing, to have a shell-shaped configuration or a combination of cup-shaped and a shell-shaped configuration.

On a front region of the housing 52, which front region in particular faces away from a main handle 54 of the portable power tool 12, the portable power tool 12 comprises at least one tool holding fixture 56 for receiving an insertable tool 58. The tool holding fixture 56 can have any configuration appearing expedient to a person skilled in the art, such as, for example, a configuration in the form of a clamping jaw chuck, in the form of an SDS® tool holding fixture, SDS® Plus tool holding fixture, in the form of an SDS® Max tool holding fixture or the like. The portable power tool 12 is furthermore designed with a releasable additional handle 60. The additional handle 60 can be fastened releasably to the housing 52, in particular to the transmission housing, via a latching connection or other connections appearing expedient to a person skilled in the art.

In order to generate a driving torque and in order to generate a percussion pulse by means of the percussion unit 50, the portable power tool 12 has a drive unit 62. Via an output unit 64 of the portable power tool 12, a driving torque of the drive unit 62 is transmitted to the percussion unit 50 in manner already known to a person skilled in the art in order to generate a percussion pulse. However, it is also conceivable for the portable power tool 12 to be designed decoupled from the output unit 64 and for the drive unit 62 to substantially act directly on the percussion unit 50 in order to generate a percussion pulse. A percussion pulse of the percussion unit 50 is generated in a manner known to a person skilled in the art. Furthermore, the output unit 64 is used to transmit the driving torque in a manner already known to a person skilled in the art to the tool holding fixture 56 in order to generate a rotational movement of the insertable tool 58 via a guide element (not illustrated specifically here), which is configured as a hammer tube, of the percussion unit 50 and/or via a rotational carry-along element arranged on the tool holding fixture 56. In order, in particular in a drilling mode or in a hammer drill mode of the portable power tool 12, to prevent what are referred to as rotation accidents due to blocking of the insertable tool 58 by a reaction torque acting on the portable power tool 12, the portable power tool 12 preferably has a unit 66, which is already known to a person skilled in the art, for determining a relative angle of rotation of the housing 52 of the portable power tool 12.

Furthermore, the portable power tool 12, in particular the hammer drill and/or chisel hammer, comprises at least one switching device 10. The switching device 10 for the portable power tool 12, in particular for the hammer drill and/or chisel hammer, comprises at least one operating mode selection unit 14 which has at least one movably, in particular rotatably, mounted operating element 16 for selecting an operating mode of the portable power tool 12. The operating element 16 is mounted movably, in particular rotatably, on the housing 52. The operating element 16 is preferably designed as a rotary toggle. A movement axis 68, in particular an axis of rotation, of the operating element 16 runs transversely, in particular at least substantially perpendicularly, to a main axis of extent 70 of the portable power tool 12 and/or with respect to a percussion axis 72 of the percussion unit 50. The main axis of extent 70 preferably extends from the main handle 54 in the direction of the tool holding fixture 56. The percussion axis 72 of the percussion unit 50 preferably extends at least substantially parallel, in particular coaxially, to an axis of rotation of the tool holding fixture 56. In an alternative configuration of the switching device 10 that is not illustrated specifically here, it is conceivable for the operating element 16 to be mounted in a translationally movably manner and for a movement axis 68, in particular a linear axis, of the operating element 16 to run at least substantially parallel to the main axis of extent 70 of the portable power tool 12 and/or to the percussion axis 72 of the percussion unit 50.

The switching device 10 furthermore comprises at least one locking unit 18 for locking the operating element 16 in at least one movement position of the operating element 16, in particular in at least one rotational position of the operating element 16 assigned to an operating mode of the portable power tool 12 (cf. FIGS. 1, 4, 5 and 6). The locking unit 18 has at least one movably mounted locking element 20 which, depending on a locking position of the locking element 20, triggers an electric and/or electronic signal for switching an operating mode of the portable power tool 12 (cf. FIGS. 2, 3, 5 and 6). The locking element 20 is mounted movably on the operating element 16. In particular, the locking element 20 is mounted in a translationally movable manner on, in particular in, the operating element 16 (cf. FIGS. 1 to 4). The operating element 16 has a bearing recess 74 in which the locking element 20 is movably mounted. A movement axis 48 of the locking element 20 runs transversely, in particular at least substantially perpendicularly, with respect to the movement axis 68 of the operating element 16. The locking unit 18 comprises at least one spring element 76 which acts upon the locking element 20 with a spring force acting in a direction directed away from the operating element 16 (cf. FIG. 4). The spring element 76 is designed in particular as a compression spring. However, it is also conceivable for the spring element 76 to have a different configuration appearing expedient to a person skilled in the art, such as, for example, a configuration as a tension spring, as a torsion spring or the like. The spring element 76 is supported at one end on the operating element 16 and the spring element 76 is supported at a further end on the locking element 20. The locking element 20 has a securing extension 78 which is provided to secure the locking element 20 on the operating element 16 against unintentional release from the operating element 16 (cf. FIG. 4). The securing extension 78 is designed as a latching extension which interacts with a latching projection 80 of the operating element 16. In order to permit removal of the locking element 20 from the operating element 16, the securing extension 78 is designed to be elastically deflectable (cf. FIG. 4).

The operating mode selection unit 14 comprises at least one movably, in particular translationally movably, mounted intermediate element 22 which, in order to trigger an electric and/or electronic signal for switching an operating mode of the portable power tool 12, is movable by the locking element 20 into at least one locking position of the locking element 20 depending on a movement of the locking element 20 (cf. FIGS. 2, 3, 5 and 6). Depending on a movement of the locking element 20, the intermediate element 22 is preferably movable by the locking element 20 into at least one locking position of the locking element 20 assigned to a chisel mode of the portable power tool 12. The intermediate element 22 is mounted movably, in particular translationally movable, on the housing 52, in particular on the transmission housing. However, it is also conceivable, as an alternative or in addition to the translationally movable mounting, for the intermediate element 22 to be mounted rotatably on the housing 52, in particular on the transmission housing. A movement axis 34 of the intermediate element 22 runs at least substantially parallel to the main axis of extent 70 of the portable power tool 12 and/or to the percussion axis 72 of the percussion unit 50. The movement axis 34 of the intermediate element 22 runs transversely, in particular at least substantially perpendicularly, with respect to the movement axis 68 of the operating element 16. The intermediate element 22 has at least three limbs 38, 40, 42 which are angled relative to one another, wherein at least two of the three limbs 38, 40, 42 run at least substantially parallel to one another. The intermediate element 22 is preferably designed as a push rod, in particular as an angled push rod. The operating mode selection unit 14 has at least one spring element 26 which acts upon the intermediate element 22 with a spring force in the direction of the locking element 20. The spring element 26 of the operating mode selection unit 14 is preferably supported at at least one end on the intermediate element 22 and the intermediate element 22 is supported at a further end on the housing 52 or on an intermediate flange (not illustrated specifically here) of the portable power tool 12.

The locking unit 18 has at least one latching contour 24 which, for locking the operating element 16 in at least one movement position of the operating element 16, interacts with the locking element 20, wherein at least the intermediate element 22 in at least one state at least partially engages in the latching contour 24, in particular in at least one latching recess 82 of the latching contour 24, said latching recess being assigned to a chisel mode of the portable power tool 12. The latching contour 24 is arranged on the housing 52, in particular on the transmission housing. The latching contour 24 comprises at least three latching recesses 82, 84, 86. One latching recess 82 of the three latching recesses 82, 84, 86 is assigned to a chisel mode of the portable power tool 12. One latching recess 84 of the three latching recesses 82, 84, 86 is assigned to a hammer drill mode of the portable power tool 12. One latching recess 86 of the three latching recesses 82, 84, 86 is assigned to a drilling mode of the portable power tool 12.

The locking element 20 has at least one actuating surface 44 for a dynamic effect of an operator force, and at least one locking surface 46 which is arranged offset along the movement axis 48 of the locking element 20 relative to the actuating surface 44. At least in an unactuated state of the locking element 20, the actuating surface 44 of the locking element 20 extends beyond an outer circumference of the operating element 16. Convenient actuation of the locking element 20 for releasing locking of the operating element 16 in order to select an operating mode of the portable power tool 12 can advantageously be permitted by means of a movement, in particular a rotational movement, of the operating element 16. The locking surface 46 of the locking element 20 is provided to engage, in particular latch, in one of the latching recesses 82, 84, 86, depending on a movement position of the operating element 16, in particular in order to lock the operating element 16 in at least one movement position, in particular in at least one movement position of the operating element 16 assigned to an operating mode. In at least one state, the intermediate element 22 at least partially engages in the latching recess 82 of the latching contour 24, said latching recess being assigned to a chisel mode of the portable power tool 12.

Figure 2:
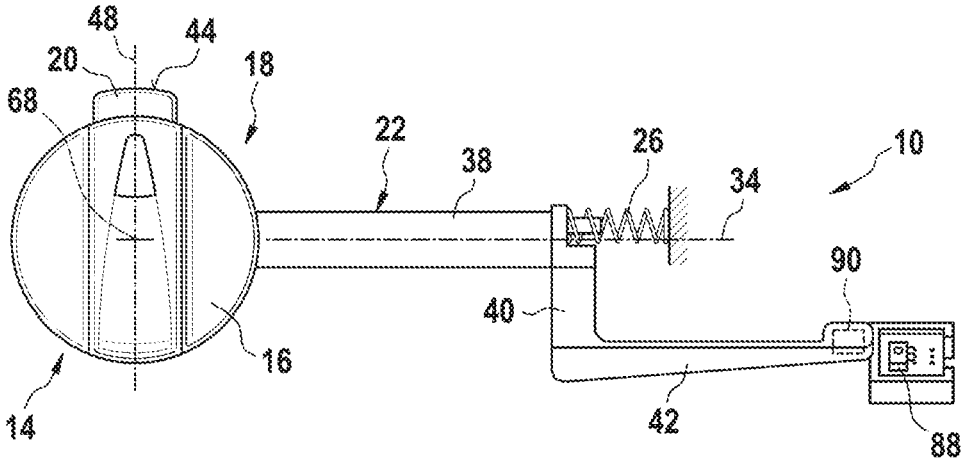
FIG. 2 shows a schematic illustration of a detailed view of a switching device according to the disclosure of the portable power tool according to the disclosure in an operating position of the switching device assigned to a hammer drill mode.
Figure 3:
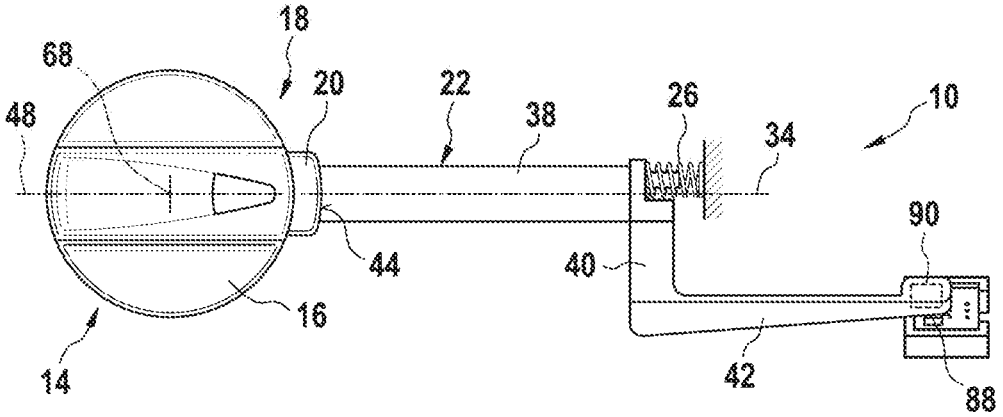
FIG. 3 shows a schematic illustration of a detailed view of the switching device according to the disclosure of the portable power tool according to the disclosure in an operating position of the switching device assigned to a chisel mode.
Figure 4:
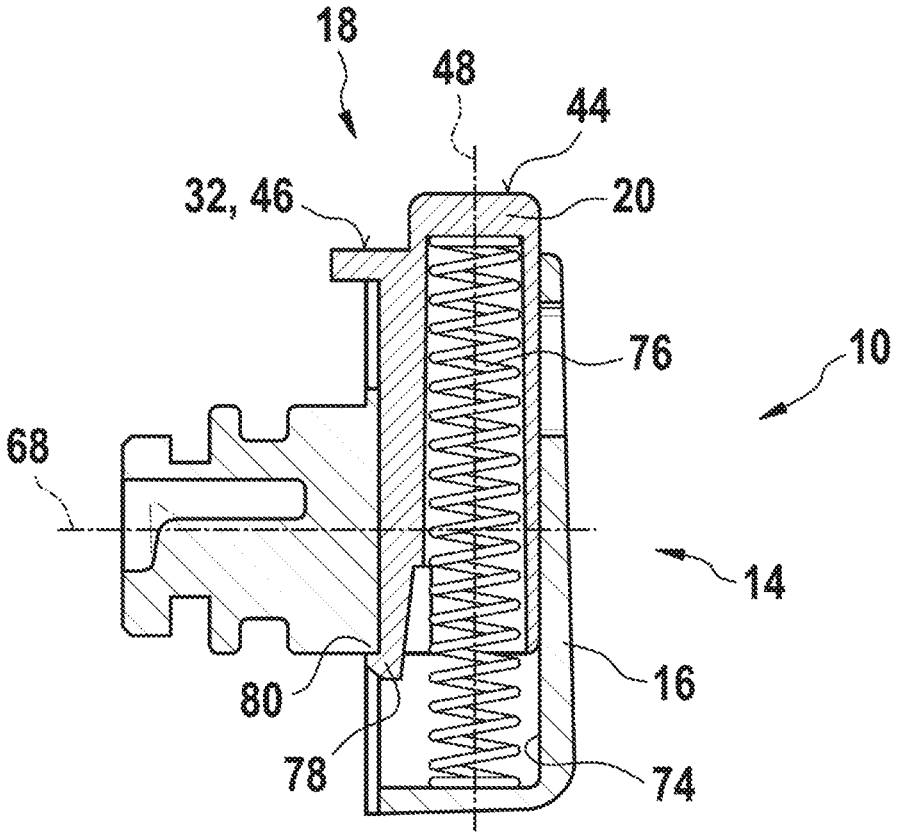
FIG. 4 shows a schematic illustration of a sectional view of an operating element of an operating mode selection unit of the switching device according to the disclosure and of a locking element, which is arranged thereon, of a locking unit of the switching device according to the disclosure.
Figure 5:
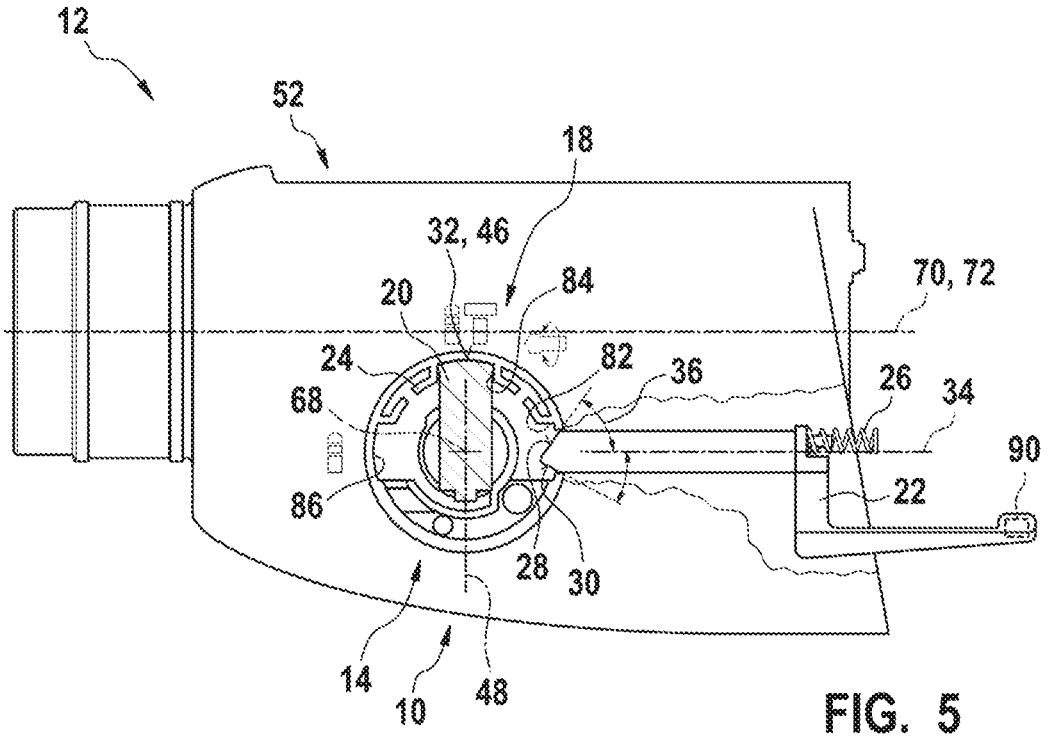
FIG. 5 shows a schematic illustration of a detailed view of the locking element in a locking position assigned to the hammer drill mode and of an intermediate element of the operating mode selection unit in a state unactuated by the locking element.
Figure 6:
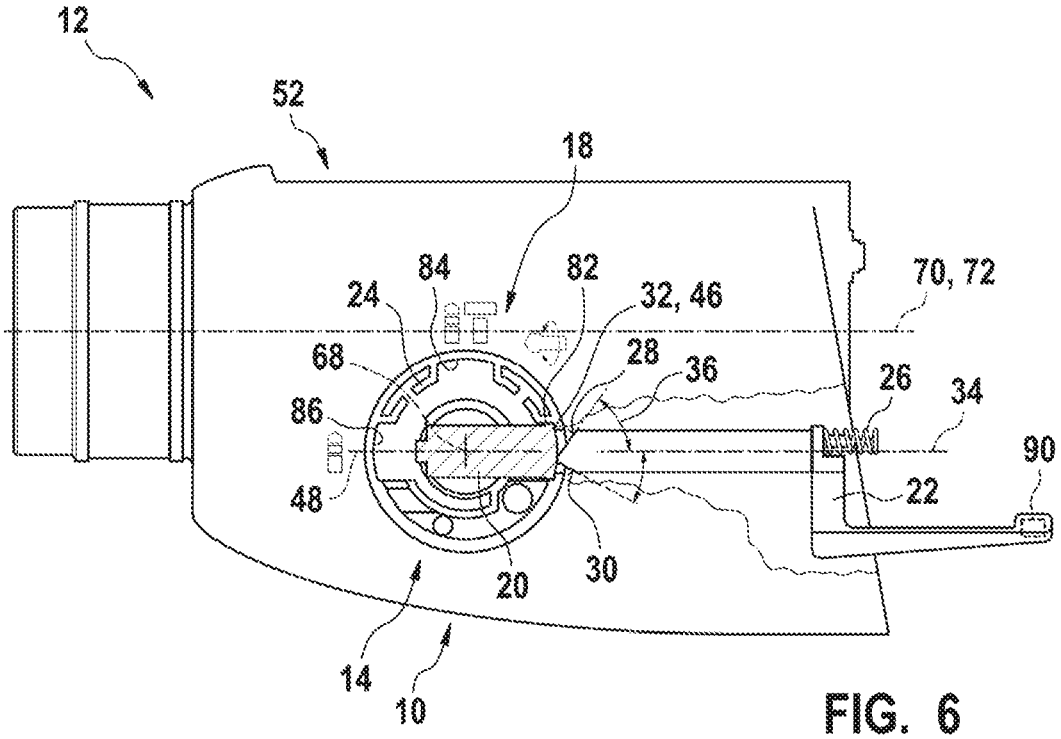
FIG. 6 shows a schematic illustration of a detailed view of the locking element in a locking position assigned to the chisel mode and of the intermediate element of the operating mode selection unit in a state actuated by the locking element.

During engagement, in particular latching, of the locking surface 46 of the locking element 20, the intermediate element 22 is at least partially movable out of the latching recess 82 of the latching contour 24, said latching recess being assigned to a chisel mode of the portable power tool 12 (cf. FIG. 6). The locking surface 46 of the locking element 20 preferably forms a contact surface 32 of the locking element 20 for movement of the intermediate element 22. The intermediate element 22 has at least one contact surface 28, 30, in particular two contact surfaces 28, 30 which are angled with respect to each other and, for a movement of the intermediate element 22, interact with the corresponding contact surface 32 of the locking element 20 depending on a movement of the locking element 20 into at least one locking position of the locking element 20. The contact surface 28, 30 of the intermediate element 22 encloses an angle 36 differing from 90° with the movement axis 34 of the intermediate element 22. An abrupt movement of the intermediate element 22 can advantageously be very substantially avoided. A gentle transition from one position of the intermediate element 22 to a further position in which a switching element 88 of the switching device 10 is actuable by means of the intermediate element 22 can advantageously be achieved (FIGS. 2 and 3).

In particular, the intermediate element 22 is provided to interact directly with the switching element 88 of the switching device 10, in particular with an end of the intermediate element 22 which faces away from the locking element 20. The switching element 88 is preferably designed as a Hall sensor. A magnet element 90, in particular a permanent magnet, is preferably arranged on the intermediate element 22 and is provided to interact with the Hall sensor in a manner already known to a person skilled in the art in order to trigger an electric and/or electronic signal. Alternatively, it is conceivable for the switching element 88 to be designed as an electric switch, in particular as a microswitch, as an inductive proximity sensor, as a light barrier or as another switching element which appears expedient to a person skilled in the art and is actuable by means of a movement of the intermediate element 22. By means of the configuration according to the disclosure of the switching device 10, it can advantageously be ensured that, as a result of securely latching the locking element 20 in the latching contour 24, reliable triggering of an electric and/or electronic signal for switching an operating mode of the portable power tool 12 is realized.

What is claimed is:

1. A switching device for a portable power tool, comprising:

an operating element movable to a selected movement position of a plurality of movement positions, each movement position of the plurality of movement positions corresponding to an operating mode of the portable power tool;

a locking element mounted directly on the operating element and movable relative to the operating element to a locking position, the locking element in the locking position configured (i) to lock the operating element in the selected movement position, and (ii) to trigger an electric signal to switch the operating mode of the portable power tool;

an intermediate element translationally movable relative to the operating element; and a plurality of latching contours mounted to a housing of the portable power tool, the operating element configured for rotational movement relative to the plurality of latching contours, wherein the locking element is configured to move the intermediate element to trigger the electric signal, wherein the locking element is configured to move into a selected latching contour of the plurality of latching contours to lock the operating element in the selected movement position, and wherein the intermediate element is movable into a particular latching contour of the plurality of latching contours in at least one state of the intermediate element.

2. The switching device according to claim 1, further comprising:

at least one spring element configured to bias the intermediate element toward the particular latching contour.

3. The switching device according to claim 2, wherein:

the locking element has a contact surface configured to contact a corresponding contact surface of the intermediate element to move the intermediate element out of the particular latching contour.

4. The switching device according to claim 3, wherein:

the intermediate element defines a movement axis, and an angle is defined between the corresponding contact surface of the intermediate element and the movement axis, and the angle is less than 90°.

5. The switching device according to claim 1, wherein the intermediate element is a push rod.

6. The switching device according to claim 1, wherein:

the intermediate element has at least three limbs; and two limbs of the at least three limbs run at least substantially parallel to one another.

7. The switching device according to claim 1, wherein:

the locking element has an actuating surface for a dynamic effect of an operator force; and the locking element has a locking surface arranged offset along a movement axis of the locking element relative to the actuating surface.

8. The switching device according to claim 1, wherein the operating element is rotatably mounted.

9. The switching device according to claim 8, wherein the plurality of movement positions of the operating element are rotational positions of the operating element.

10. A portable power tool, comprising:

at least one switching device, including:

an operating element movable to a selected movement position of a plurality of movement positions, each movement position of the plurality of movement positions corresponding to an operating mode of the portable power tool;

a locking element mounted directly on the operating element and movable relative to the operating element to a locking position, the locking element in the locking position configured (i) to lock the operating element in the selected movement position, and (ii) to trigger an electric signal to switch the operating mode of the portable power tool;

an intermediate element translationally movable relative to the operating element; and a plurality of latching contours mounted to a housing of the portable power tool, the operating element configured for rotational movement relative to the plurality of latching contours, wherein the locking element is configured to move the intermediate element to trigger the electric signal, wherein the locking element is configured to move into a selected latching contour of the plurality of latching contours to lock the operating element in the selected movement position, and wherein the intermediate element is movable into a particular latching contour of the plurality of latching contours in at least one state of the intermediate element.

11. The switching device according to claim 10, wherein the portable power tool is a hammer drill and/or chisel hammer.

* * * * *